US005713757A

United States Patent [19]

Karst et al.

[11] Patent Number: 5,713,757

[45] Date of Patent: Feb. 3, 1998

[54] ASSEMBLY FOR SUPPLYING POWER

[75] Inventors: Ronald E. Karst, Kendallville; Ryan K. Sliger, Corunna, both of Ind.

[73] Assignee: Pent Assemblies, Inc., Kendallville, Tenn.

[21] Appl. No.: 760,140

[22] Filed: Dec. 3, 1996

Related U.S. Application Data

[63] Continuation of Ser. No. 439,094, May 10, 1995, abandoned.

[51] Int. Cl.[6] ..... H01R 13/56

[52] U.S. Cl. ..... 439/445

[58] Field of Search ..... 439/456, 460, 439/465–468, 470, 473, 610, 445, 446, 447

[56] References Cited

U.S. PATENT DOCUMENTS

| | | | |
|---|---|---|---|
| Re. 31,733 | 11/1984 | Haworth et al. . | |
| 861,468 | 7/1907 | Kreinsen . | |
| 1,984,181 | 12/1934 | French . | |
| 1,989,893 | 2/1935 | Taylor . | |
| 2,239,846 | 4/1941 | Gifford . | |
| 2,326,181 | 8/1943 | Sundquist et al. . | |
| 2,334,436 | 11/1943 | Perbal . | |
| 2,511,772 | 6/1950 | Finizie . | |
| 2,570,784 | 10/1951 | Ferguson . | |
| 2,869,102 | 1/1959 | Hubbell, Jr. . | |
| 2,968,690 | 1/1961 | Higgins . | |
| 3,601,746 | 8/1971 | Teagno . | |
| 3,754,205 | 8/1973 | Lenkey . | |
| 3,760,338 | 9/1973 | Bruels . | |
| 3,794,960 | 2/1974 | Sugar . | |
| 3,950,069 | 4/1976 | Wiley . | |
| 4,199,206 | 4/1980 | Haworth et al. . | |
| 4,241,965 | 12/1980 | Wilson et al. . | |
| 4,277,123 | 7/1981 | Haworth et al. . | |
| 4,377,724 | 3/1983 | Wilson | 174/48 |
| 4,421,376 | 12/1983 | Cosmos et al. . | |
| 4,432,592 | 2/1984 | Boutros et al. . | |
| 4,445,739 | 5/1984 | Wooten . | |
| 4,508,414 | 4/1985 | Kusui et al. | 439/610 |
| 4,579,403 | 4/1986 | Byrne . | |
| 4,592,612 | 6/1986 | Kikuta | 439/610 |
| 4,593,960 | 6/1986 | Millhimes et al. . | |
| 4,722,580 | 2/1988 | Kocher et al. | 439/466 |
| 4,959,021 | 9/1990 | Byrne | 439/310 |
| 4,964,815 | 10/1990 | Kawai et al. | 439/610 |

(List continued on next page.)

FOREIGN PATENT DOCUMENTS

| | | |
|---|---|---|
| 648698 | 3/1985 | Switzerland . |

*Primary Examiner*—Gary F. Paumen

*Attorney, Agent, or Firm*—Taylor & Associates, P.C.

[57] ABSTRACT

An assembly for supplying power to a system of modular wall panels may include a housing, a lid, and a sleeve positionable on a conduit and disposed between the lid and housing. The sleeve is configured to have a predetermined shape that cooperates with structure on either the lid, the housing, or both to fix the conduit in a plurality of different orientations or positions with respect to the housing and lid. The sleeve may include positioning means, such as a key, and the housing may be configured to include an opening in which the positioning means is selectively positionable in a first orientation whereby the conduit assumes a first position with respect to the housing and a second orientation whereby the conduit assumes a second position with respect to the housing that is different than the first position. The housing may include a second opening in which the positioning means is disposed when the conduit assumes the second position. The sleeve may be configured to include second positioning means and the lid configured to include an opening in which the second positioning means is disposed. Alternatively, the housing and/or lid may include positioning means and the sleeve may have one or more openings in which the positioning means is disposable, in various orientations, to fix the conduit in a plurality of different positions. The assembly may additionally include a plug-in connector coupled to the conduit that is configured to plug into a corresponding connector.

9 Claims, 6 Drawing Sheets

U.S. PATENT DOCUMENTS 5,076,802 12/1991 Colleran et al. ..... 439/468
5,092,786 3/1992 Juhlin et al. ..... 439/215
5,096,433 3/1992 Boundy ..... 439/215
5,203,713 4/1993 French et al. ..... 439/215
5,271,739 12/1993 Denlinger et al. ..... 439/466
5,354,212 10/1994 Bartle et al. ..... 439/468

ASSEMBLY FOR SUPPLYING POWER

This is a continuation of application Ser. No. 08/439,094, filed May 10, 1995now abandoned.

BACKGROUND AND SUMMARY OF THE INVENTION

The present invention relates to an assembly for supplying power to modular wall panels.

In modern offices, modular wall panels are often used to construct separate offices or bays within a larger office space. These wall panels are often used because of the flexibility they provide with regard to varying office and bay configurations as needed or desired. Often, it is desirable to provide electrical power to the various wall panels so that computers and other office equipment may be operated from the various offices and bays.

Numerous systems have been designed for providing power to modular wall panel office systems. Certain of these systems include a wiring harness comprising a relatively flat channel with wires running therethrough. An end unit or connector is secured to each end of the channel. The end units mate with similar end units on an adjoining wiring harness on a different panel to electrically couple the panels. These systems also include a receptacle connector or distributor for coupling with a plug-in receptacle to power computers or other equipment at various locations along the wall panel system.

Obviously, it is necessary to couple the wiring harness system to a power supply, such as the office building's main electrical system. Typically, this system is located within the building's permanent walls. Accordingly, the wiring harness system may be powered by hard-wiring one of the harnesses to electrical cables protruding from a wall in the office space. Because the individual harnesses are electrically coupled by the end units, power is supplied along the entire length of the wiring harness system. However, this method of powering the wiring harness system may be undesirable because it does not provide a ready means for disconnecting the system from the power source.

Alternatively, an end unit or connector may be attached to the cable or other means protruding from the office wall and coupled with a corresponding end unit or connector on a wiring harness. This method of powering the system may be desirable because it provides a relatively quick and easy method for connecting and disconnecting the wiring harness system from the power supply. Although these connectors generally provide a more convenient way to power the wiring harness system than hard-wiring, they may have certain limitations as well. For example, it may be that the end unit or connector of the cable or other means must engage the wiring harness end unit or connector in a particular direction for such coupling to occur. If so, the flexibility normally associated with modular wall panel systems may be reduced because of the necessity of positioning a panel having a wiring harness with an end unit or connector oriented in the desired direction adjacent the end unit or connector through which power is supplied. Alternatively, the end unit, connector, or wiring harness attached to the power supply could be detached and replaced with a different end unit, connector, or wiring harness. However, both of these options increase the amount of time and effort needed to rearrange a system of wall panels.

Accordingly, it is object of the present invention to provide an improved assembly for supplying power to a system of modular wall panels.

Another object of the present invention is to provide an assembly for supplying power to a system of modular wall panels, the orientation of which may be readily changed to facilitate coupling to the modular wall panel system.

These and other objects of the present invention are attained by the provision of an assembly for supplying power that, in one or more embodiments, may include a housing, a lid coupled to the housing, and a sleeve positionable on a conduit and disposed between the lid and the housing. The sleeve is configured to have a predetermined shape that cooperates with structure on either the lid, the housing, or the lid and housing to fix the conduit in a plurality of different orientations with respect to the housing and lid. The sleeve may be configured to have a generally oblong-shape and the housing and lid may each be configured to include a portion having a shape that generally corresponds to the shape of the sleeve so that the sleeve is positionable adjacent the housing and lid portions to fix the conduit in each of the plurality of different orientations. In one or more embodiments, the sleeve may have a generally round shape and the housing and lid portions may have a generally concave shape.

In other embodiments of the present invention, the housing is configured to include an opening and the sleeve is configured to include positioning means, such as a key, selectively disposable in a first orientation within the opening so that the conduit assumes a first position with respect to the housing and lid and a second orientation within the opening so that the conduit assumes a second position with respect to the housing and the lid that is different than the first position. The sleeve may be configured to include a second positioning means and the lid may be configured to include an opening in which the second positioning means is disposed. The second positioning means may lie generally opposite the first positioning means.

In yet other embodiments of the present invention, the sleeve may have a generally round exterior surface on which positioning means, such as a key, is formed and the housing may be configured to include a wall in which first and second openings are formed. In these embodiments, the wall has a generally concave shape to receive the sleeve. In these embodiments, the positioning means is disposable in the first opening when the conduit is in the first position and the second opening when the conduit is in the second position.

The first and second positions for each of the various embodiments of the present invention may be located at an angle of approximately 180° with respect to one another. It should be noted, however, that other angles between the first and second positions are also within the scope and spirit of the present invention.

The lid may be configured to include a depending end wall positioned on the lid to lie generally opposite the sleeve to enclose a cavity between the housing and the lid. In one or more embodiments, this end wall may have a generally convex shape.

The assembly of the present invention may also include a connector, such as a plug-in connector, coupled to one or more wires within the conduit that is configured to plug into a corresponding connector. In these and other embodiments of the present invention including the plug-in connector, the housing may be configured to include a first side in which an opening is formed for routing one or more wires therethrough. The housing may further be configured to include a wall, generally opposite the first side, in which the above-described one or more openings are formed. This wall may have a generally concave shape to receive the sleeve. In addition, this wall may include an opening for routing the above-described one or more wires. The plug-in connector may include a body configured to have a plurality of protrusions or projections for positioning the housing adjacent the plug-in connector.

In still yet other embodiments of the present invention, the sleeve is configured to include an opening and the housing is configured to include positioning means, such as a key, selectively disposable in a first orientation within the opening so that the conduit assumes a first position with respect to the housing and lid and a second orientation within the opening so that the conduit assumes a second position with respect to the housing and lid that is different than the first position. This sleeve may be configured to include a second opening and the lid may be configured to also include positioning means, such as key, disposable in the second opening in both the first and second positions.

The housing may, alternatively, be configured to include first and second positioning means. In these embodiments, the first positioning means is disposable in the opening in the sleeve so that the conduit assumes a first position with respect to the housing and lid and the second positioning means is disposable in the opening in the sleeve, when the first positioning means is removed, so that the conduit assumes a second position with respect to the housing and lid that is different than the first position.

In further embodiments of the present invention, the sleeve may be configured to include an opening and the lid may be configured to include positioning means, such as a key, selectively disposable in a first orientation within the opening so that the conduit assumes a first position with respect to the housing and lid and a second orientation within the opening so that the conduit assumes a second position with respect to the housing and lid that is different than the first position. The lid may, alternatively, be configured to include first and second positioning means so that the first positioning means is disposable in the opening in the sleeve whereby the conduit assumes the first position with respect to the housing and lid and the second positioning means is disposable in the opening in the sleeve, when the first positioning means is removed, so that the conduit assumes the second position with respect to the housing and lid.

Still further embodiments of the present invention may remove the sleeve altogether. In these embodiments, the lid, the housing, or both the lid and the housing are configured to include capturing structure. This capturing structure engages the conduit, other wiring carrying structure in which one or more wires are disposed, or one or more wires alone, to secure the conduit, other wiring carrying structure, or one or more wires in one of a plurality of orientations or positions with respect to the housing and lid. This capturing structure may include such things as teeth-like projections or flanges.

Other objects, advantages and novel features of the present invention will now be readily apparent to those skilled in the art upon consideration of the detailed drawings and description below.

DETAILED DESCRIPTION OF THE PREFERRED EMBODIMENTS

Figure 1:
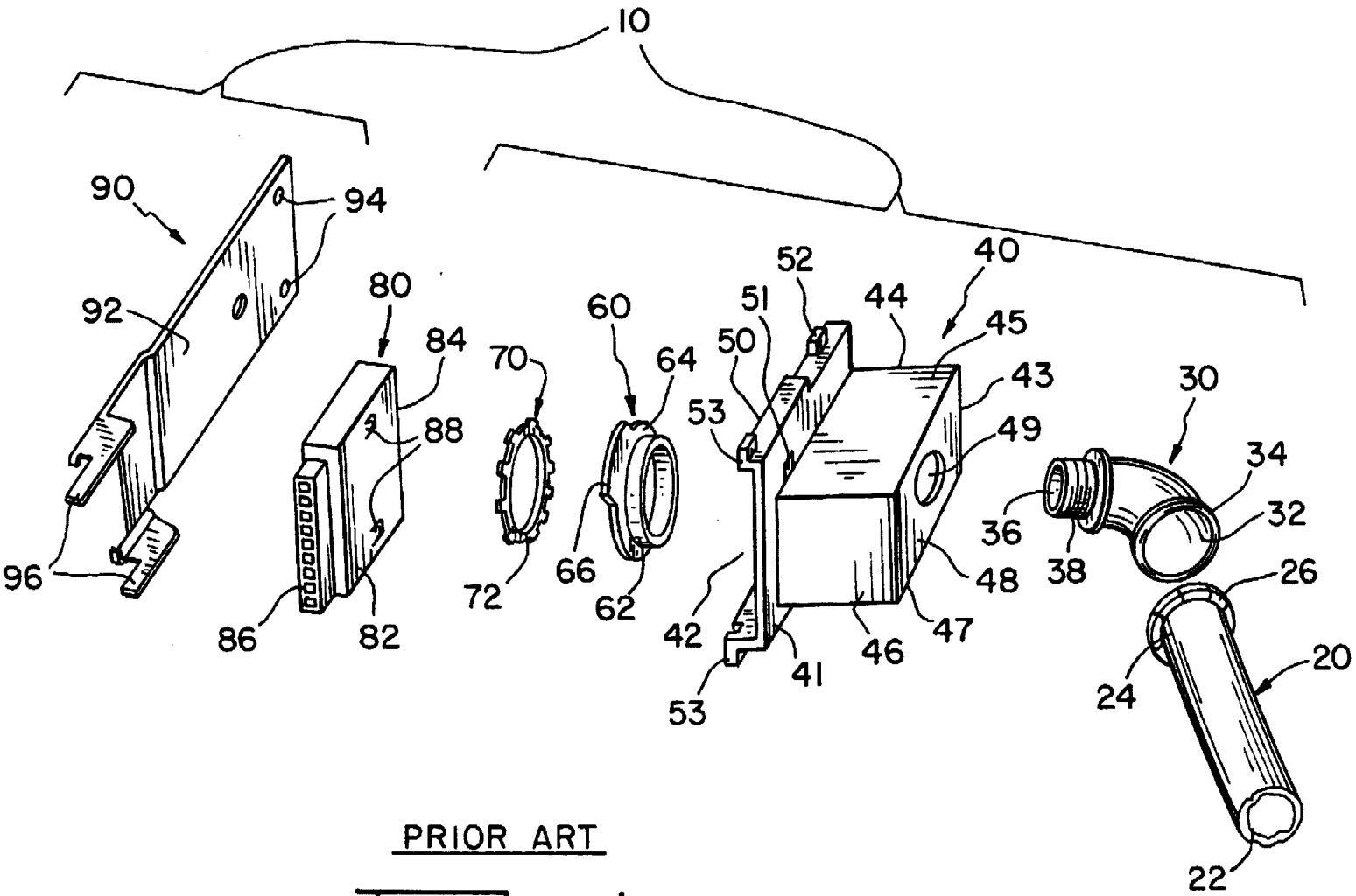
PRIOR ART Fig. 1
FIG. 1 shows an exploded perspective view of a prior art assembly for supplying power to a plug-in electrical connector.

FIG. 1 shows an exploded perspective view of a prior art assembly for supplying power to an electrical plug-in connector. The assembly is generally indicated by reference numeral 10 and comprises conduit 20, fitting 30, housing 40, washer 60, nut 70, and cover 90. The plug-in connector is generally indicated by reference numeral 80.

Conduit 20 is a substantially hollow tube having a first end 22 and second end 24. End piece 26 is secured to second end 24 of conduit 20 and is used to attach conduit 20 to fitting 30 as will be described below.

Fitting 30 has a first end 32 with threads 34 disposed around it. Second end 36 of fitting 30 similarly has threads 38 surrounding it.

Housing 40 comprises generally planar surface 41 with an open side 42 and a box 43 integrally formed thereto opposite open side 42. Box 43 comprises sidewall 44, top wall 45, second sidewall 46, bottom wall 47, and back wall 48. Back wall 48 contains an opening 49 for securing fitting 30 thereto as will be described below. Surface 41 further includes a rim 50 disposed therearound with alignment holes 51 cut therein. Alignment holes 51 are used to position plug-in connector 80 as will be described below. Rim 50 also includes a pair of shoulders 56 which further assist in aligning plug-in connector 80. A first set of tabs 52 and a second set of tabs 53 are disposed on rim 50. Tabs 52 are used to mount the assembly to a wiring harness and tabs 53 are used to secure cover 90 to housing 40, both of which procedures are described below.

Washer 60 comprises a generally circular ring 62 with a rim 64 disposed therearound and at a right angle thereto. Rim 64 has a flange 66 integrally formed therewith. Flange 66 is used to limit the rotational motion of housing 40 and connector 80 as described below.

Nut 70 is shown, for example, as a thin annular member. Nut 70 has threads 72 on the interior surface thereof for mating with threads 38 on fitting 30 as described below.

Plug-in connector 80 comprises body 82 having one open end 84. Opposite open end 84 of body 82 are plugs 86. Protrusions 88 extend from both sides of body 82 and are used to position connector 80 within housing 40 as described below.

Cover 90 comprises a generally planar member 92 with mounting holes 94 bored therein. At the opposite end of planar member 92, two arms 96 extend perpendicular thereto. Arms 96 are utilized in conjunction with tabs 53 on housing 40 to secure cover 90 to housing 40 as described below.

Figure 2:
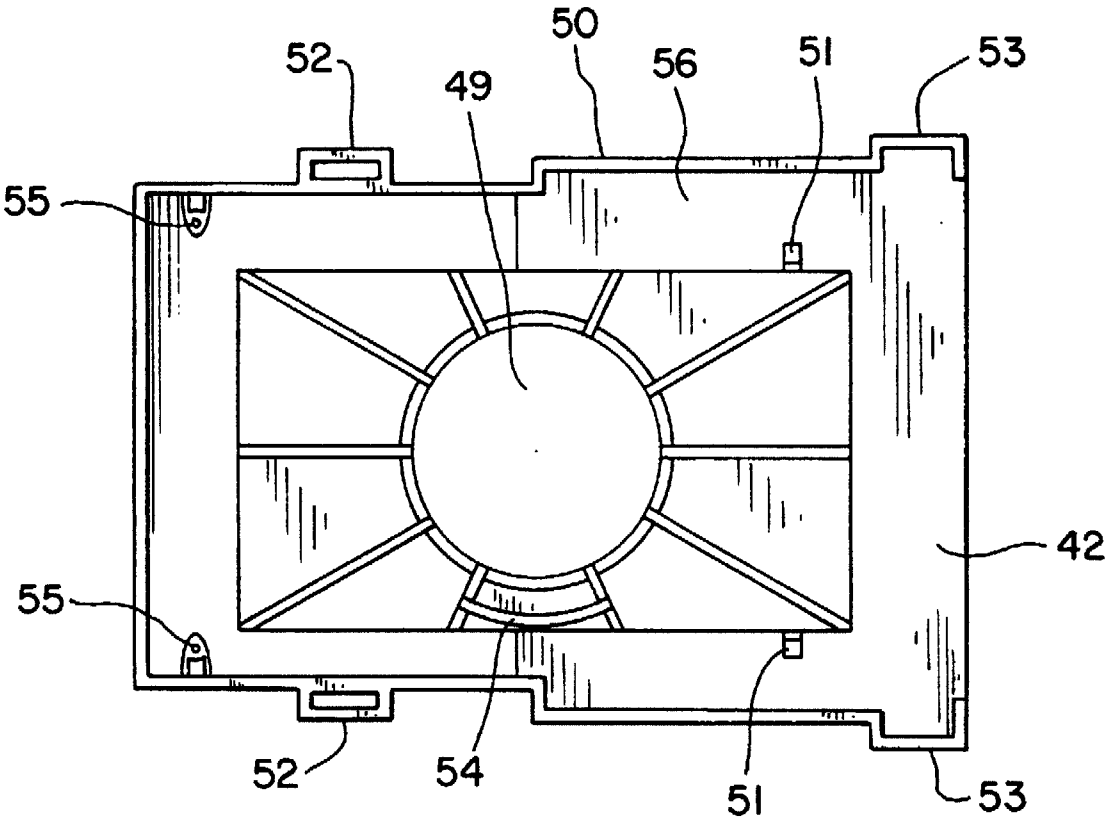
PRIOR ART Fig. 2
FIG. 2 shows an interior plan view of the housing 40 shown in FIG. 1.

Turning now to FIG. 2, the interior of housing 40 can be more clearly seen. Specifically, both openings 51 used to position connector 80 in housing 40 may be seen in FIG. 2. Also, both tabs 52 and 53 may be seen as well. Additionally, mounting holes 55 in housing 40 can also be seen. Holes 55 are used in conjunction with mounting holes 94 on cover 90 to secure cover 90 to housing 40 as described below. The interior of housing 40 also contains a raised abutment surface 54 disposed adjacent opening 49 in box 43. Abutment surface 54 works in conjunction with flange 66 on washer 60 to limit the rotational motion of housing 40 and connector 80 as described below.

To assemble the unit 10 (without connector 80 or cover 90) end piece 26 of conduit 20 is secured to threads 34 of first end 32 of fitting 30 in the conventional manner. Second end 36 of fitting 30 is then inserted in opening 49 in box 43 of housing 40 such that threads 38 protrude into box 43. Washer 60 is then inserted through open side 42 of housing 40 such that ring 62 is disposed between threads 38 of fitting 30 and the side wall of opening 49 in box 43. Nut 70 is then secured to fitting 30 by engaging threads 38 in the conventional manner. Nut 70 is tightly secured so as to clamp securely against washer 60. This arrangement can be seen in FIG. 3.

When conduit 20 and fitting 30 are secured to housing 40 in the manner described above, housing 40 is free to rotate by applying force in the direction of arrows $A_1$ or $B_1$. Because washer 60 is clamped tightly in place by nut 70, it remains stationary as housing 40 rotates. During the rotation of housing 40, the inside wall of opening 49 in box 43 rotates against ring 62 of washer 60.

Figure 3:
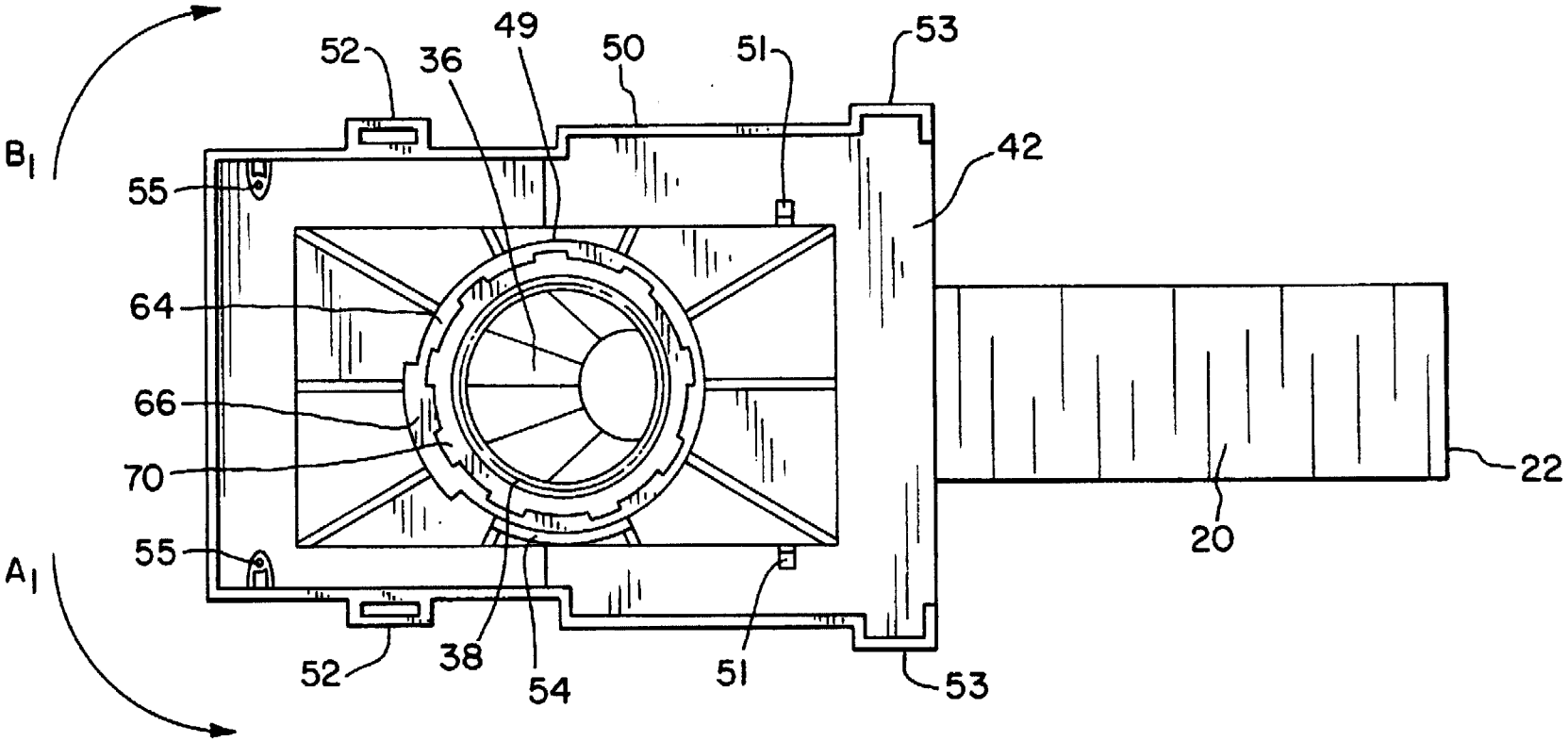
PRIOR ART Fig. 3
FIG. 3 shows an interior plan view of the housing 40 shown in FIG. 2 with the interior components of the assembly located therein.
Figure 4:
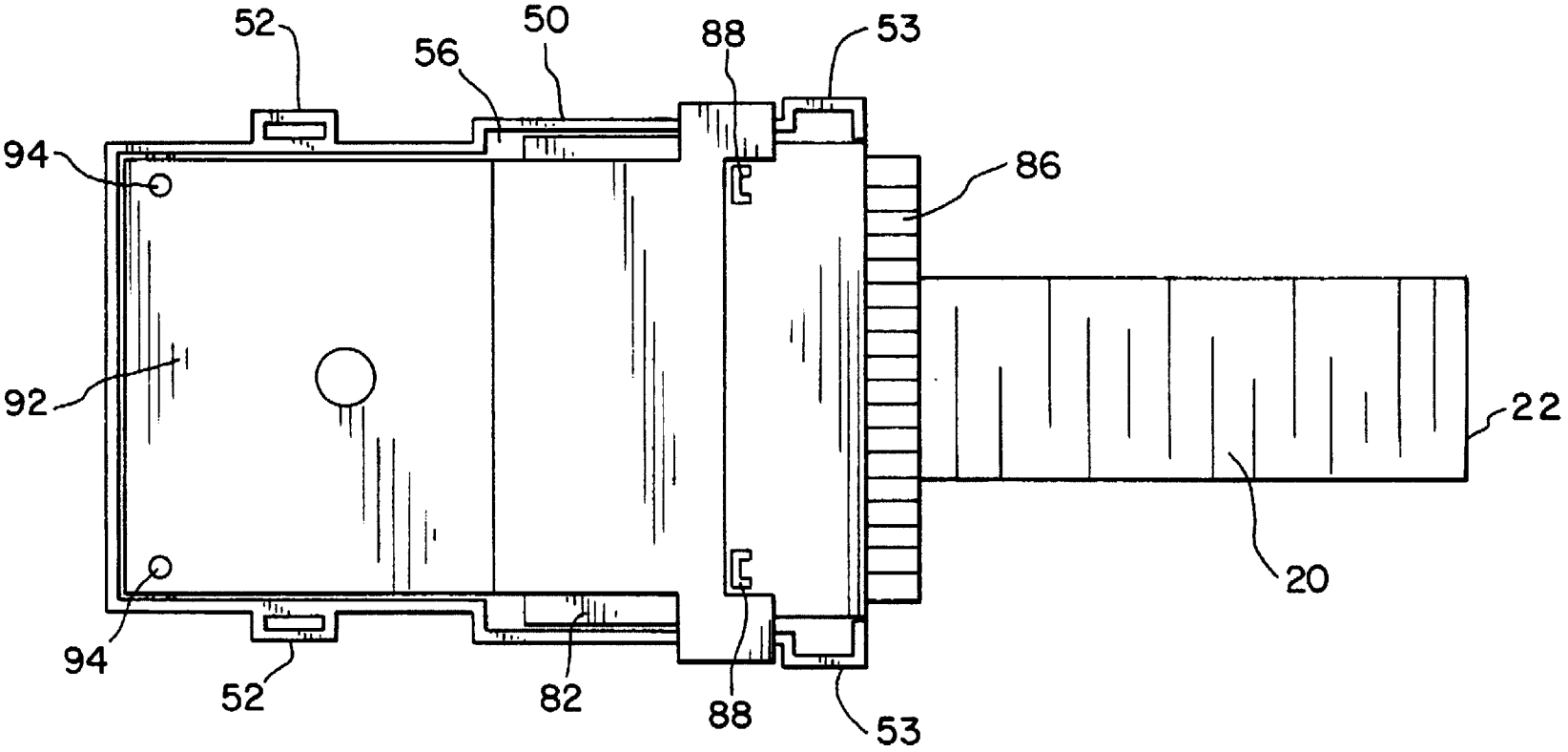
PRIOR ART Fig. 4
FIG. 4 shows a front plan view of the fully assembled assembly shown in FIG. 1.

FIG. 3 also shows how flange 66 and abutment surface 54 limit the range of rotation of housing 40. As force is applied in the direction of arrow $A_1$ (for example) housing 40, including abutment surface 54, rotate counterclockwise, while washer 60 remains stationary. Housing 40 will continue to rotate freely until the leading edge of abutment surface 54 reaches flange 66. At that point, the contact between flange 66 and abutment surface 54 will prevent any further rotation of housing 40. Similarly, applying force to housing 40 in the direction of arrow $B_1$ will cause housing 40 to rotate clockwise. Again, when the leading edge of abutment surface 54 reaches flange 66 further rotation of housing 40 will be prevented. The range of motion of housing 40 can be limited as desired by varying the length of abutment surface 54 and/or flange 66. The smaller the total length of abutment surface 54 and flange 66, the greater the degree of rotation housing 40 will have.

Once conduit 20 has been secured to housing 40 as shown in FIG. 3, plug-in connector 80 may be secured in housing 40 by positioning it therein such that body portion 82 rests against shoulder 56 and one set of protrusions 88 on one side of body 82 extend through openings 51 in surface 41 of housing 40. Cover 90 is then positioned over open side 42 of housing 40 such that mounting holes 94 in planar member 92 are in line with mounting holes 55 of housing 40, planar member 92 abuts a second set of protrusions 88 on body member 82, and legs 96 straddle rim 50 of housing 40 and hook under tabs 53. Cover 90 may then be secured to housing 40 by inserting screws or similar fasteners through holes 94 and into holes 55 of housing 40.

To supply power to connector 80, wires or cables connected to a power source are run through conduit 20 from first end 22, through second end 24, into first end 32 of fitting 30, out second end 36 of fitting 30, into housing 40, and into open end 84 of connector 80. Inside body member 82 of connector 80, the wires or cables are connected to the appropriate internal components which allow the power supply to be accessed by engaging plugs 86 with an appropriate receptacle.

Figure 5:
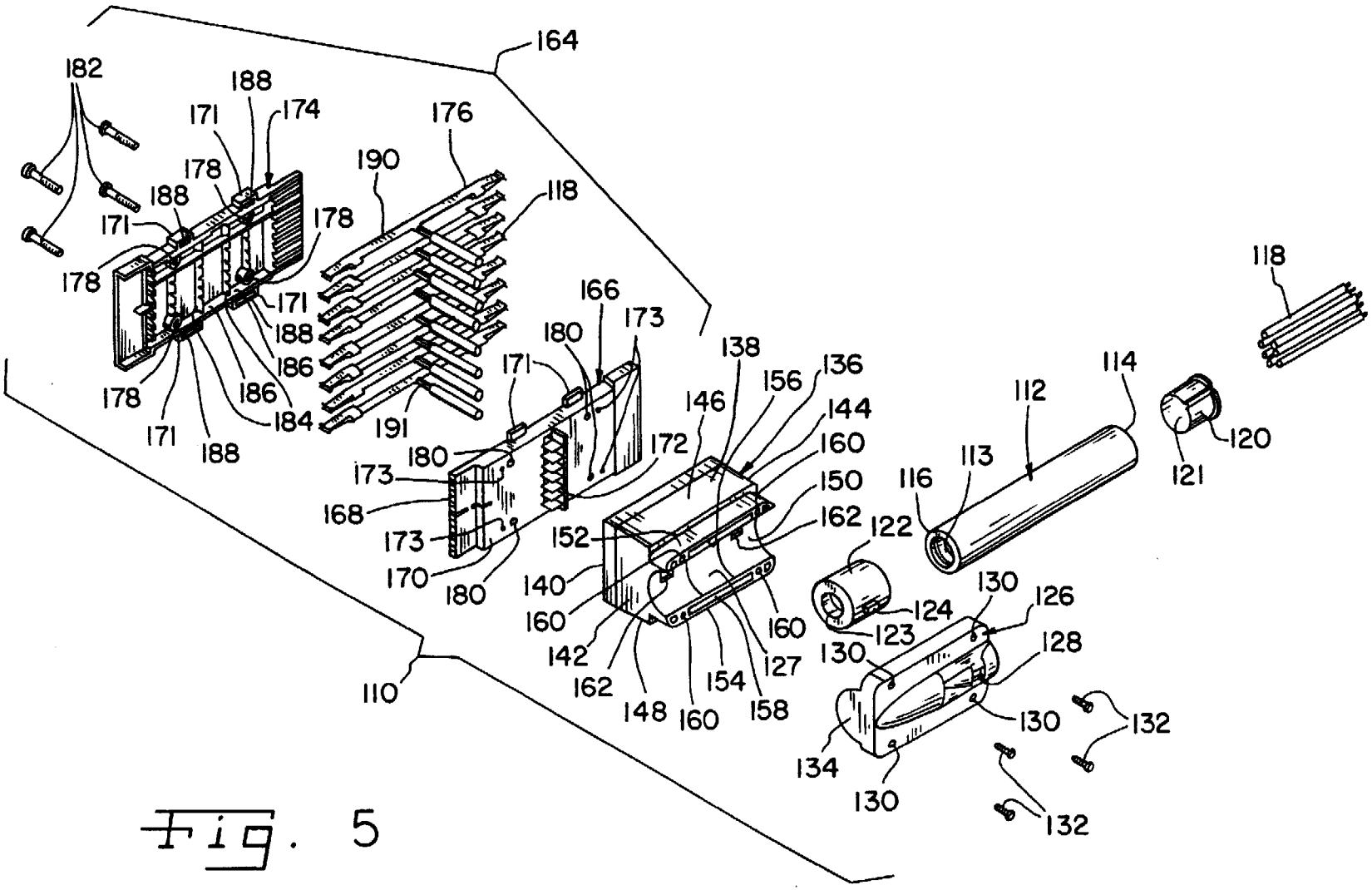
FIG. 5 shows an exploded perspective view of an assembly for supplying power in accordance with the present invention.
Figure 6:
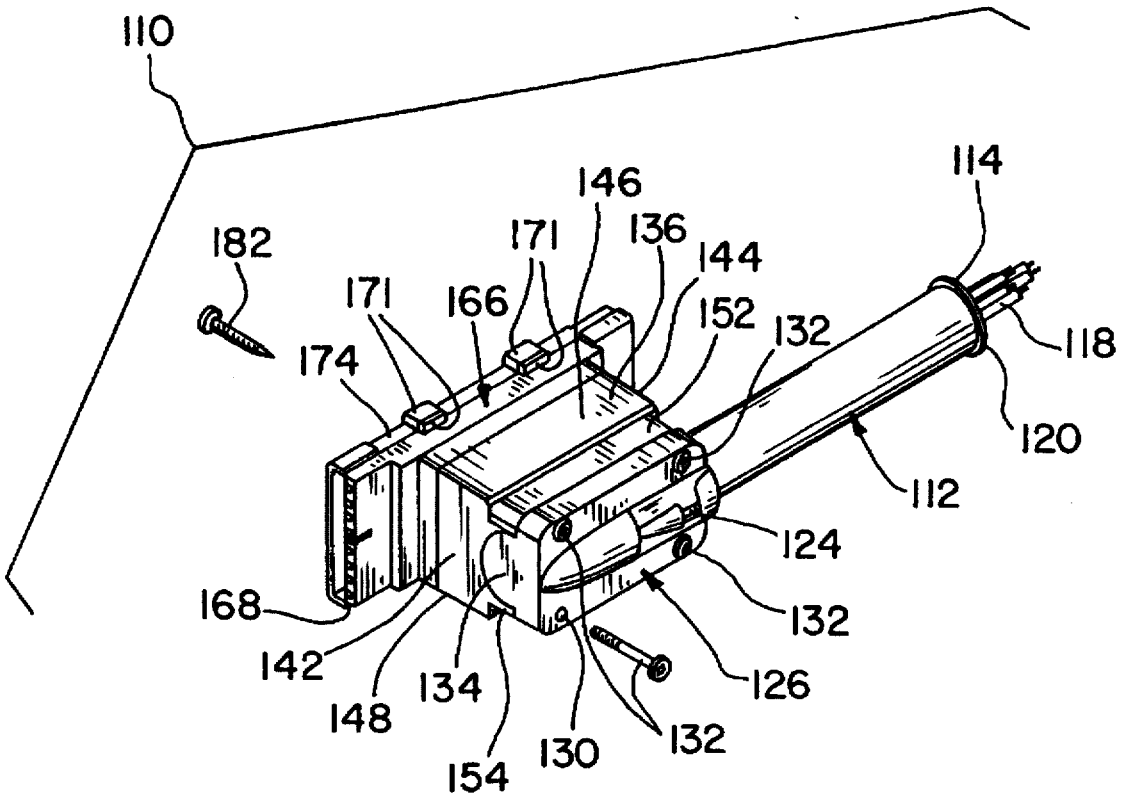
FIG. 6 shows an assembled perspective view of the assembly shown in FIG. 5.

An exploded perspective view of an assembly 110 for supplying power in accordance with the present invention is shown in FIG. 5. An assembled perspective view of assembly 110 is shown in FIG. 6. Assembly 110 includes a conduit 112 having a first end 114 and a second end 116. A plurality of wires 118 are disposed in conduit 112 through opening 113 therein. In one or more embodiments of assembly 110, there may be eight wires 118 within conduit 112. Although a conduit 112 is shown, it is to be understood that the present invention may be used with other wire configurations as well. For example, embodiments of the present invention may be used with ribbon cables having one or more wires. Furthermore, although a plurality of wires 118 are shown as being disposed within conduit 112, it is to be understood that embodiments of the present invention will work with only one wire as well.

An anti-short grommet 120 having an opening 121 is disposed within first end 114 of conduit 112 to help prevent wires 118 from coming in direct contact with conduit 112 which may result in shorting. Assembly 110 also includes a sleeve 122 disposed on second end 116 of conduit 112. Sleeve 122 is formed to include a pair of generally opposing positioning means or keys 124 (only one of which is shown), that are separated from one another by an angle of approximately 180 degrees. Although a pair of keys 124 are shown, it is to be understood that more than two keys 124 may be formed on sleeve 122. Alternatively, in one or more other embodiments of assembly 110, one key 124 is formed on sleeve 122. Assembly 110 further includes a lid 126 formed to include an opening 128 that receives one of keys 124. Lid 126 is also formed to include a plurality of openings 130 that receive fasteners 132 used to couple assembly 110 together as discussed below. Lid 126 is additionally formed to include a depending end wall 134 that is positioned to lie adjacent housing 136 when assembly 110 is coupled together. As can be seen, end wall 134 has a generally convex shape.

Housing 136 of assembly 110 includes a box 138 having a side 140 in which an opening (not shown) is formed. Alternatively, side 140 may be partially or completely open. Box 138 also includes a first side wall 142, an opposing second side wall 144, a top wall 146, an opposing bottom wall 148, a back wall 150, and a pair of plugs 152 and 154 formed adjacent respective top and bottom walls 146 and 148 of housing 136. Although the terms first, second, top, bottom, and back have been used, it is to be understood that these terms merely describe the embodiment of the present invention illustrated in FIGS. 5 and 6 and are not intended, in any way, to limit the present invention. As is apparent in FIG. 5, first side 142 and second side 144 adjoin with back wall 150 to define a first semi-circular opening and a second semi-circular opening, respectively.

Plugs 152 and 154 are each formed to include respective elongated core outs 156 and 158. In some embodiments of assembly 110, core outs 156 and 158 may receive depending keys or flanges formed on lid 126 (not shown) when assembly 110 is coupled together. Plugs 152 and 154 are also formed to include openings 160 that receive fasteners 132. Back wall 150 is formed to include a pair of openings 162, one of which receives one of keys 124 when assembly 110 is coupled together.

Although a pair of openings 162 are shown, it is to be understood that, in other embodiments of assembly 110, more than two openings 162 may be formed in back wall 150. Alternatively, in one or more other embodiments of assembly 110, only one opening 162 is formed in back wall 150. Furthermore, in one or more other embodiments of assembly 110, the positions of keys 124 and openings 128 and 162 can be changed. For example, one or more keys 124 may be formed on either or both lid 126 and housing 136 and one or more corresponding openings formed in sleeve 122.

Additional embodiments of the present invention may remove keys 124 and the corresponding openings in lid 126 and housing 136 altogether, replacing them with a particularly shaped sleeve 122 that is positioned between back wall 150 and lid 126. Lid 126, back wall 150, or lid 126 and back wall 150 may, in turn, be configured to have a shape that corresponds to the particular shape of sleeve 122 to fix conduit 112 in a plurality of different orientations or positions.

Still further embodiments of the present invention may remove sleeve 122 altogether. In these embodiments, lid 126, housing 136, or both lid 126 and housing 136 are configured to include capturing structure. This capturing structure engages conduit 112, other wiring carrying structure in which one or more wires 118 are disposed, or one or more wires 118 alone, to secure the conduit, other wiring carrying structure, or one or more wires in one of a plurality of orientations or positions with respect to the housing and lid. This capturing structure may include such things as teeth-like projections or flanges.

Assembly 110 also includes a plug-in connector 164 that has a body 166 formed to include a plurality of plugs 168 at a first end 170 thereof. Body 166 also includes portions of two-piece mounting flanges 171, corresponding portions of which are on cover 174. Body 166 additionally includes dividers 172 that help route wires 118 to terminals 176 and projections or protrusions 173 that help position side 140 of housing 136 onto body 166.

Connector 164 also includes a cover 174 and a plurality of terminals 176 disposed between body 166 and cover 174. Cover 174 and body 166 are each formed to include respective openings 178 and 180 which receive fasteners 182 that are used to couple body 166 and cover 174 together. As can be seen, cover 174 is formed to include a plurality of racks 184 having notches 186 that receive a portion 190 of terminals 176 to help position them within cover 174. Terminals 176 may also each be formed to include a portion 191, each of which connects with or couples to one of the wires 118 by, for example, crimping. Alternatively, wires 118 may be directly coupled or attached to terminals 176 by, for example, soldering. Cover 174 is further formed to include core outs 188 in mounting flanges 171 as shown.

Assembly 110 is put together by inserting anti-short grommet 120 in first end 114 of conduit 112 and sleeve 122 on second end 116 of conduit 112. Wires 118 are then routed through opening 121 of grommet 120, opening 113 in conduit 112, opening 123 in sleeve 122, opening 127 in wall 150 of housing 136, the opening in side 140, and through dividers 172 to terminals 176. One of keys 124 of sleeve 122 is then positioned in one of the openings 162 in back wall 150. Lid 126 is then attached to housing 136 by disposing fasteners 132 through openings 130 and 160 of respective lid 126 and housing 136. The other key 124 of sleeve 122 is disposed through opening 128 when lid 126 is attached to housing 136. It will be appreciated that the general appearance of assembly 110 when assembled is the same regardless of the orientation of lid 126; therefore, only one of two possible orientations of lid 126 is shown in FIGS. 5 and 6.

Plug-in connector 164 is assembled by placing portions 190 of terminals 176 in notches 186 of racks 184. Body 166 and cover 174 are then assembled together by disposing fasteners 182 through openings 178 and 180 in respective cover 174 and body 166. Side 140 of housing 136 is next positioned on protrusions 173 of body 166 and housing 136 attached to body 166 by disposing fasteners 182 in cavities or openings (not shown) of housing 136. In the disclosed embodiment of assembly 110, lid 126 is formed to include a depending end wall 134. First and second side walls 142 and 144 as well as back wall 150 are formed to include a generally concave shape, as shown, so that depending end wall 134 closes lid 126 and housing 136 when assembled. This helps prevent objects from entering assembly 110. Once assembly 110 is put together, it can be readily connected to a wiring harness by plugging connector 164 into a corresponding connector. Although a particular order for assembling the components of the present invention has been given, it is to be understood that these components may be assembled together in other ways as well. For example, plug-in connector 164 may be assembled together first.

The direction at which wires 118 within conduit 112 enter housing 136 can be reversed (i.e. rotated approximately 180 degrees) as follows. Lid 126 is removed from housing 136 by removing fasteners 132 from openings 160. Next, lid 126 is lifted away from housing 136 so that key 124 is removed from opening 128. Next, the other key 124 of sleeve 122 is removed from one of openings 162 and the assembly of sleeve 122, conduit 112, anti-short grommet 120, and wires 118 are reversed or rotated 180 degrees with respect to the housing 136 and plug-in connector 164. Alternatively, the assembly of housing 136 and plug-in connector 164 can be rotated or moved 180 degrees with respect to the assembly of sleeve 122, conduit 112, an anti-short grommet 120 and wires 118. Next, one of keys 124 is placed in the other opening 162 in back wall 150 of housing 136. Next, lid 126 is placed on housing 136 so that the other key 124 of sleeve 122 is disposed within opening 128, and openings 130 and 160 are aligned. Next, fasteners 132 are disposed within aligned openings 160 to secure lid 126 and housing 136 together again.

Although the present invention has been described above in detail, the same is by way of illustration and example only, and not to be taken as a limitation of the invention. The spirit and scope of this invention are limited only by the scope and content of the following claims.

What is claimed is:

1. A power supply assembly for supplying power to an electrical plug-in connector associated with a modular wall panel, said power supply assembly comprising:

a housing having a plurality of sides, one of said sides at least partially defining a first opening therein and another of said sides at least partially defining a second opening therein;

a lid attached to said housing in one of two orientations, said lid covering said first opening in said housing and not covering said second opening in said housing when said lid is disposed in a first one of said two orientations, and said lid covering said second opening in said housing and not covering said first opening in said housing when said lid is disposed in a second one of said two orientations; and a conduit defining a passageway for wires, said conduit having an end which is disposed in said opening in said housing which is not covered by said lid.

2. The power supply assembly of claim 1, wherein said lid includes a depending end wall, said end wall covering one of said openings in said housing.

3. The power supply assembly of claim 1, further comprising a sleeve disposed between said housing and said lid and within said non-covered opening in said housing, said sleeve having an opening, said conduit disposed within said opening in said sleeve.

4. The power supply assembly of claim 3, wherein said sleeve includes a positioning means for preventing relative movement between said housing and said sleeve.

5. The power supply assembly of claim 4, wherein said housing includes a pair of further openings associated with each said opening in said two sides, and wherein said positioning means comprises at least one key extending from said sleeve, one of said keys being received within one of said further openings.

6. The power supply assembly of claim 1, wherein each of said housing and said lid include a plurality of screw receiving openings, and further comprising a plurality of corresponding screws received within said screw receiving openings for attaching said lid to said housing.

7. The power supply assembly of claim 1, wherein each of said openings in said two side walls have a concave shape.

8. The power supply assembly of claim 7, wherein each of said openings in said two side walls have a generally semi-circular cross-sectional shape.

9. The power supply assembly of claim 7, wherein said housing includes a back wall defining each of said two openings.

* * * * *

UNITED STATES PATENT AND TRADEMARK OFFICE

CERTIFICATE OF CORRECTION

PATENT NO. : 5,713,757

DATED : February 3, 1998

INVENTOR(S) : Ronald E. Karst, et al.

It is certified that error appears in the above-identified patent and that said Letters Patent is hereby corrected as shown below:

Title page, item [73]

Line 5, delete "Tenn.", and substitute --Ind.--.

COLUMN 1

Line 4, delete "1995now" and substitute --1995, now-- therefor.

Signed and Sealed this

Twenty-first Day of April, 1998

Bruce Lehman

*Attest:*

BRUCE LEHMAN

*Attesting Officer*

*Commissioner of Patents and Trademarks*